US005477905A

United States Patent [19]

Knapp et al.

[11] Patent Number: 5,477,905

[45] Date of Patent: Dec. 26, 1995

[54] COMPOSITES AND METHOD THEREFOR

[75] Inventors: Christopher K. Knapp, Hamilton, Canada; Donald R. Gorsuch, Northboro, Mass.; Sjur V. Velken, Lillesand, Norway; Eric M. Klier, Somerville, Mass.; Andreas Mortensen, Cambridge, Mass.; James A. Cornie, Cambridge, Mass.; Merton C. Flemings, Cambridge, Mass.

[73] Assignee: Massachusettes Institute of Technology, Cambridge, Mass.

[21] Appl. No.: 970,443

[22] Filed: Nov. 2, 1992

Related U.S. Application Data

[60] Continuation of Ser. No. 524,406, Apr. 18, 1990, abandoned, which is a division of Ser. No. 208,086, Jun. 17, 1988, abandoned.

[51] Int. Cl.[6] ..... B22D 19/14

[52] U.S. Cl. ..... 164/61; 164/97

[58] Field of Search ..... 164/91, 97, 98, 164/100, 101, 102, 103, 104, 105

[56] References Cited

U.S. PATENT DOCUMENTS

| | | | |
|---|---|---|---|
| 4,473,103 | 9/1984 | Kenney | 164/97 |
| 4,617,979 | 10/1986 | Suzuki | 164/97 |
| 4,720,434 | 1/1988 | Kubo | 420/537 |
| 4,759,995 | 7/1988 | Skibo | 420/532 |
| 4,777,014 | 10/1988 | Newkirk | 164/97 |
| 4,828,008 | 5/1989 | White | 164/97 |
| 4,871,008 | 10/1989 | Dwivedi | 164/97 |
| 4,918,034 | 4/1990 | Weinstein | 501/88 |
| 4,935,055 | 6/1990 | Aghajanian | 164/97 |
| 4,961,461 | 10/1990 | Klier | 164/900 |
| 4,977,947 | 12/1990 | Boswell | 164/97 |
| 5,007,475 | 4/1991 | Kennedy | 164/97 |

*Primary Examiner*—P. Austin Bradley
*Attorney, Agent, or Firm*—Bruce F. Jacobs

[57] ABSTRACT

Composites of materials in which the matrix material does not spontaneously or readily wet the disperse phase and in which the volume fraction of the disperse phase is less than that formed in a packed bed of dispersate particles can be made effectively by an indirect method of infiltrating a packed bed of dispersate particles, using pressure or other mechanical force as needed to overcome poor wetting and form an intermediate concentrated composite. The concentrated composite is then mixed with additional matrix-forming material to produce the finally desired composite. The technique is particularly valuable for composites with ceramic dispersates and metal or alloy matrixes.

17 Claims, 6 Drawing Sheets

A357/SiC F600 M.A.
400X 3/21/88

A357/F600 20% FROM M.A.
400X 3/22/88

606I/SiC F600 20% FROM M.A.
400X 3/21/88

MICROSTRUCTURE OF
99.9Al/15VOL%
SiC COMPOSITE
SiC HEAT TREATED
IN AIR 1300C
30 MIN. BEFORE
INFILTRATION

COMPOSITES AND METHOD THEREFOR

RIGHTS OF THE UNITED STATES GOVERNMENT HEREIN

Part of the work described in this application was performed under the terms of Contract # NAG-3-808-N00014-85-K-0645 between the United States government and the Massachusetts Institute of Technology. The United States accordingly has certain rights to use of the technology described herein. This is a continuation of copending applications Ser. No. 07/524,406 filed on Apr. 18, 1990 now abandoned which is a divisional of U.S. Ser. No. 07/208,086, filed on Jun. 17, 1988, now abandoned.

TECHNICAL FIELD

This invention relates to solid composite materials comprising a continuous matrix material and a plurality of separate particles, called dispersates, of one or more materials distinct from the matrix, dispersed through the matrix, and to methods for making such composites. The invention is particularly related to composites in which the dispersates are substantially uniformly distributed throughout the volume of the composite, and is more particularly related to composites in which the matrix is a metal or alloy and the dispersates are ceramic and to the reduction of porosity that normally accompanies the introduction of ceramic particulate reinforcement into molten alloys or alloys in the semi-solid state.

TECHNICAL BACKGROUND

Composite materials often have better mechanical properties than either the matrix or the dispersates alone. The good properties are generally maximized when the dispersates are distributed as uniformly as possible within the matrix, but making composites with such uniform dispersion has often proved difficult.

One method for making composites in which the matrix material can readily be obtained by solidification of or chemical reaction from a fluid state is to disperse the dispersates in a precursor liquid and then form the composite by solidifying the liquid part (or "dispersion medium") of the dispersion. A significant practical difficulty with this simple method is that any difference in density between the dispersates and the dispersion medium may cause a generally undesired segregation of the dispersates toward either the top or bottom of the dispersion and thus of the final composite.

U.S. Pat. No. 4,735,656 of Apr. 5, 1988 to Schaefer et al. teaches a method of avoiding segregation due to density differences by mixing metal particulates with ceramic particulates, heating the mixture to a temperature sufficient to cause partial melting of the metal so that it fuses into a dense matrix when cooled, but insufficient to cause the ceramic particulates to float in the metal matrix.

Another frequent problem with simple mixing is that some of the most desirable composites are made from dispersates that are difficult to wet by any known fluid precursor of the desired matrix phase. International Patent Application WO 87/06624, published Nov. 5, 1987, teaches a method of ameliorating the difficulties when using dispersates that are difficult to wet, by using specific types of dispersing and/or sweeping impellers that promote high shear mixing while minimizing the introduction of gas into the mixture and the retention of gas at the interface between the dispersates and the dispersion medium. U.S. Pat. No. 4,662,429 of May 5, 1987 to Wada et al. teaches use of lithium in a melt of aluminum matrix alloy to facilitate wetting of the reinforcing material and ready dispersal thereof in the matrix alloy. European Patent Application No. 87 201 512.8 published Feb. 24, 1988 describes composites of zinc - aluminum alloy reinforced with silicon carbide powder which "surprisingly" has good mechanical properties without the difficulties often experienced with other similar composites.

Difficulties in making good quality composites, and various expedients tried to overcome them, are generally reviewed by P. K. Rohatgi et al. in "Solidification, structures, and properties of cast metal-ceramic particle composites", 31 *International Metals Reviews* 115–39 (1986). One method from Rohatgi is described in more detail by B. C. Pai et al., 13 *Journal of Materials Science* 329–35 (1978). This method involves pressing together dispersates with powdered matrix material to form a pellet, introducing this pellet beneath the surface of a quantity of fluid matrix precursor material for long enough to melt the pellet matrix, stirring to disperse the dispersates within the total amount of fluid precursor material, and then solidifying the dispersion. Analogously, J. Cisse et al. in 6B *Metallurgical Transactions* 195–97 (1975) describe use of a "master alloy" of rods made from sintered aluminum powder and containing 10% of aluminum oxide.

A. Mortensen et al. in the *Journal of Metals* for February 1988, pages 12–19, gives another review of the field and refers to Rohatgi et al. as listing a number of techniques for introducing particulates, including pre-infiltrating a packed bed of particulates to form a pellet or master "alloy" and redispersing and diluting into a melt.

All the prior art methods known to applicants initially produce composites with substantial porosity unless the dispersates are quite easily wet by the fluid matrix material, and in the latter case, the properties of the composite are often degraded by chemical reaction between the matrix and the dispersates. It is therefore an object of this invention to produce composites as free as possible from porosity and to minimize the time required to make the composite, so that chemical degradation of the interfaces in the composite is minimized.

SUMMARY OF THE INVENTION

The properties of composites that are most desirable for many purposes are achieved when the dispersates are sufficiently widely dispersed that most of them do not touch another dispersate particle. This type of composite is characterized herein as having "discrete" dispersates or as a "discrete" dispersion. It has been found in accordance with this invention that many of the difficulties of the prior art in making composites with discrete dispersates can be overcome by using an indirect method. This involves first making a concentrated dispersion in which there is intimate contact between a precursor of the final matrix desired and the dispersates. Preferably the concentrated dispersion has no more than five volume percent of voids and/or gases. Still more preferably, porosity is substantially entirely eliminated from the concentrated composite. Dispersions with these characteristics can be more readily made with higher concentrations of dispersates than is usually most preferred in the final product.

The concentrated dispersion is used for the formation of a more dilute dispersion by mixing it with additional fluid precursor of the matrix of the finally desired composite. If this mixing is done while the dispersion medium of the concentrated dispersion is still fluid, the particular embodiment of the invention is described herein as a "continuous"

method. Sometimes, it is more convenient to solidify the dispersion medium of the concentrated dispersion, producing what is called herein a "concentrated composite", before beginning the mixing step that leads to the finally desired composite. Composites made in this way are denoted as made by the "concentrated composite" embodiment of the invention.

It has been found that a satisfactory concentrated dispersion according to this invention can be made by packing dispersates into a porous bed, in which most dispersates are touching at least one other dispersate, then infiltrating the packed bed with a fluid precursor of the desired final matrix in such a way that (i) the reasonably uniform distribution of dispersates characteristic of the packed bed is maintained during the infiltration and (ii) most if not all of the gas existing in the interparticle volume of the bed is displaced during the infiltration. In this way, the infiltrated part of the packed bed of dispersates is converted into a concentrated dispersion suitable for use in this invention.

If the porous bed of dispersates is evacuated, infiltration of fluid into the bed may be accomplished from all directions if convenient. Often, however, it is more convenient to avoid any need for evacuation by infiltrating the porous bed from one direction only, allowing displaced gas to escape through a part of the bed that remains open as infiltration proceeds. Even when the fluid precursor used does not spontaneously wet the dispersates, infiltration of the bed may be achieved with the application of pressure to the fluid. The process of infiltration may, and in fact preferably does, separate some of the interparticle contacts between dispersates, but the dispersion produced by infiltration will still be more concentrated than the final desired dispersion.

The mixing of the concentrated dispersion with additional precursor fluid should normally be accomplished in a way that avoids the difficulties encountered when attempting to disperse small particles directly in an open container of fluid. It has been found that concentrated dispersions made by the methods described herein often have the very favorable property that, at some temperatures, they behave as if the dispersates were so well bonded to the matrix that each dispersate tended to carry a substantial amount of matrix material along with it when moved. With these favorable concentrated dispersions according to the invention, mixing is very easy. Portions of the concentrated dispersion can simply be placed on top of a second matrix fluid, if the dispersates are denser than the matrix, or covered with a second matrix fluid, if the dispersates are less dense than the matrix. A combination of the influences of gravity and stirring then serves to mix the dispersates into the total amount of fluid precursor for the final matrix.

This invention can still be used even with concentrated dispersions that do not have such favorable properties as described above. For the continuous embodiment of the invention, it is often convenient to provide a pressurizable reservoir of concentrated dispersion from which the dispersion can be injected into a quantity of the second precursor fluid. It is generally preferred to inject the concentrated dispersion into a flowing stream of the second precursor fluid, in order to aid mixing. For the concentrated composite method, a portion of the concentrated composite can be held mechanically below the surface of a body of second precursor fluid, maintained at a temperature high enough to reliquefy at least part of the matrix of the concentrated composite, and portions of the two components of the concentrated composite can be mixed into the second precursor fluid as the liquefaction occurs. Alternatively, the concentrated composite can be heated to and an held at a temperature sufficient for partial liquefaction of its matrix, and additional fluid precursor added with mixing.

High shear mixing is often preferred to disperse small clusters or agglomerates of dispersates remaining from the concentrated dispersion. High shear mixing is also useful to provide a uniform distribution in the final desired composite. During mixing, the temperature should normally be maintained, if possible for the particular dispersates and matrix used, within a range where the mixtures containing the dispersates exhibit thixotropy. In this way, efficient mixing in the immediate vicinity of the mixing zone can be achieved without as much danger of resegregation of the dispersates, due to density differences, as the mixed material moves away from the mixing zone.

In connection with this description of the invention, it should be understood that a precursor of a matrix material is any other material that can be converted to the matrix material by chemical or physical treatment without dislocating any dispersates contained therein. For example, liquid alloy or thermoplastic is a precursor of the solid alloy or thermoplastic into which it hardens on cooling; fluid mixtures of polyfunctional isocyanates and polyfunctional alcohols are precursors of the polyurethanes that they can form by chemical reaction after mixing; and fluid acrylated materials are precursors of the polymer that they can form after being exposed to the action of an electron beam. Also, the term "matrix" includes the continuous phase of any dispersion or composite, whether in a fluid or a solid state.

One aspect of the invention is the final composites produced. It is believed that this invention provides the first discrete dispersions that are substantially free of pores and have substantially uniform dispersion of the dispersates, as illustrated by some of the drawing figures herein. In particular, it is believed that dispersions containing not more than 40 volume percent of dispersates and not more than 5 volume percent of voids, pores, and/or gases are new.

DESCRIPTION OF THE PREFERRED EMBODIMENTS

Figure 1:
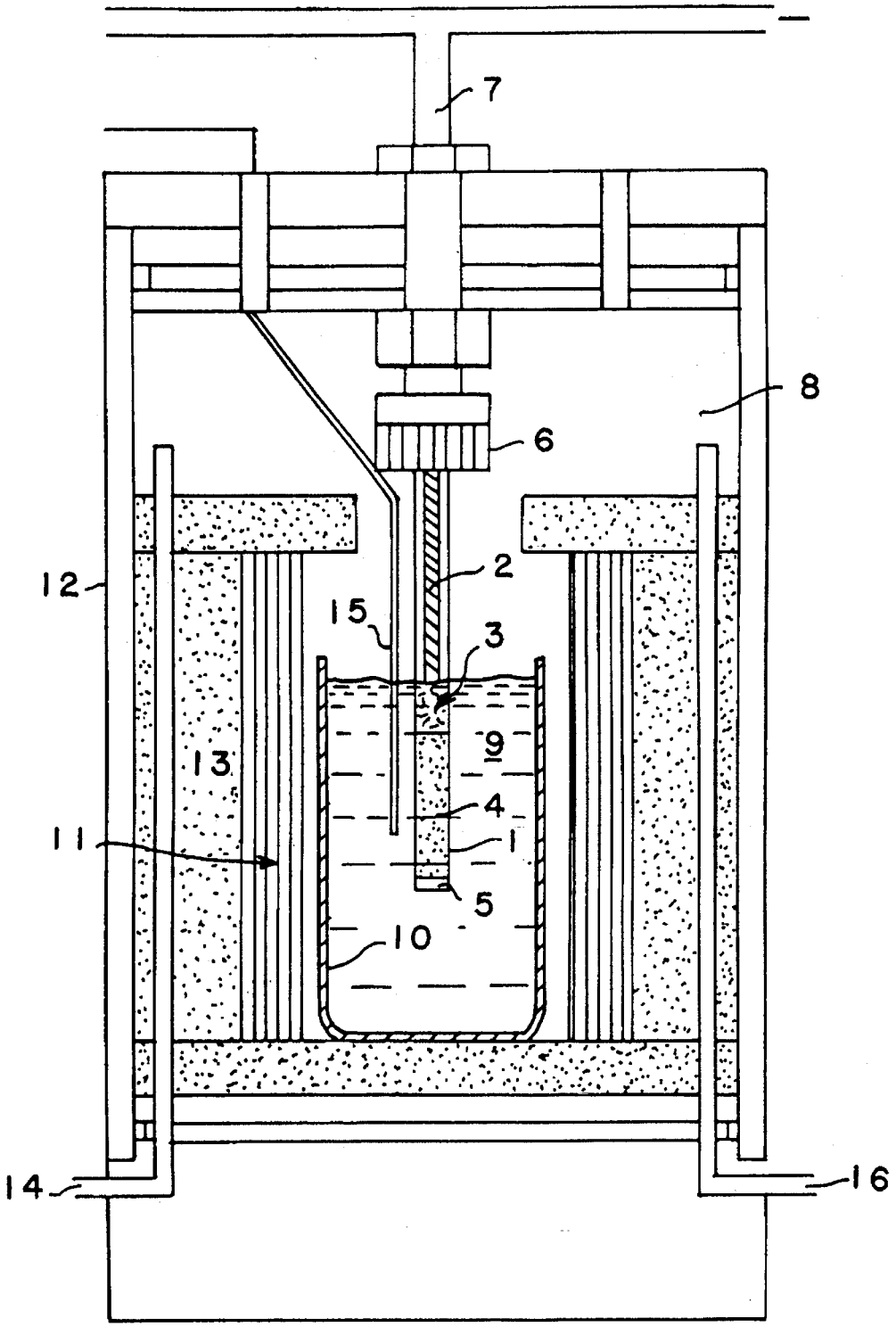
FIG. 1 is a cross section view of one type of apparatus used to practice the instant invention.

Some of the most useful applications of this invention are to the manufacture of composites of silicon carbide dispersed in aluminum or magnesium alloys. Such materials are valuable materials of construction for applications such as aircraft where a combination of low density, toughness, and flexure resistance at temperatures not too far below the melting point of the alloy are needed. In the past, it has been very difficult to make these composites with about 20 weight % silicon carbide, the most mechanically useful range, with the substantially uniform dispersion of silicon carbide particles that is needed, particularly when the silicon carbide particles are mostly less than ten microns in size and/or have a wide distribution of sizes. Such composites can readily be made by the present invention.

In order to promote good displacement of interparticle gases at lower pressures, thereby reducing the cost of infiltration processing, during the formation of composites of silicon carbide and aluminum alloy according to this invention, materials, such as tin and potassium hexafluorozirconate, that promote the wetting of silicon carbide can advantageously be added to the aluminum alloy used as the fluid material for forming the concentrated dispersion.

Alloys of aluminum containing from about 1 to 4% silicon have been found in the prior art to make stronger composites when reinforced with silicon carbide than do aluminum alloys with less silicon, even though low silicon alloys are stronger when unreinforced than the alloys containing as much as 1% silicon. The difficulty of making composites with low-silicon aluminum alloys is believed to be due to reaction between the low-silicon aluminum and the surface of silicon carbide dispersates to form aluminum carbides. This weakens the silicon carbide particles and makes them less effective reinforcement.

The difficulties with low silicon aluminum can readily be overcome with the present invention by coating the silicon carbide dispersate particles with some material that inhibits the reaction with aluminum. Silicon dioxide, which can be formed on silicon carbide by heating it in air, is particularly convenient. Heating silicon carbide powder at 1300 C for 30 minutes, for example, results in particles that disperse much more easily in and form a more uniform composite with low silicon aluminum alloys. Alumina, which can conveniently be coated onto silicon carbide particles from a seeded sol, also forms a useful barrier against reaction to form aluminum carbides. Such coatings are generally not needed for final composites with magnesium based alloys, because the formation of carbides is not as extensive, even if the magnesium is alloyed with aluminum.

The practice of the invention can be further appreciated from the following non-limiting examples.

EXAMPLE 1

A quartz tube 16 cm in length with an internal diameter of 2.2 cm was coated internally for a distance of about fifteen centimeters (hereinafter cm) with a suspension of colloidal graphite available from Acheson Colloids, Ltd., Brantford, Ontario, Canada under the trade name AQUADAG. A supporting rod, narrower than the inside diameter of the quartz tube but having on one end a gas-permeable plug of porous refractory fireclay brick that fits tightly within the coated tube was then inserted from the uncoated end and positioned so that the porous plug was about ten cm from the opening of the coated end. The container thus formed by the coated tube end and the porous plug was filled with grit F600 green silicon carbide to a packing density of about 50 volume %, with the aid of a vibrating table contacting the container. (The size distribution of Grit F600 silicon carbide is described fully in publications of the Federation of European Producers of Abrasives, hereinafter designated as "FEPA") The particular lot of Grit F600 used for this experiment was measured with a Coulter Counter and had 50% of its volume in particles with a size of more than 9.1 microns; 3% of the volume was made up of grits larger than 15.3 microns, 94% of the volume was made up of grits larger than 4.8 microns, and the central 75% of the volume was made up of grits with sizes between 6.2 and 12.2 microns. The central 75% of the volume is defined as the part of the sample excluding the largest and the smallest particles that each make up 12.5% of the total volume.

The top surface of the packed bed of SiC was covered with a layer of porous alumina paper (Product APA1 from Zircar Products, Florida, N.Y.) and this end of the container was then wrapped with aluminum foil. The porous alumina paper is fitted tightly enough to keep the packed bed from falling out when the container is inverted and also serves as a filter to exclude oxides or other unwanted foreign matter when molten metal is later infiltrated into the packed bed. The use of aluminum foil allows the end of the container thus protected to be immersed below the surface of molten aluminum alloy, without contaminating the contents with the layer of oxide that forms spontaneously on molten aluminum alloys. Shortly after immersion, the aluminum foil melts. The amount of aluminum foil is too small to change the composition of the molten aluminum alloy to any significant extent.

The wrapped container with its packed bed was then placed in a gas tight desiccator that was evacuated to a pressure of no more than 0.01 bar and then backfilled with argon. The container as thus prepared was positioned within an apparatus illustrated in FIG. 1. The quartz tube 1 now has the alumina paper 5 at the bottom of the packed bed 4, with the porous fireclay plug 3 and the support rod 2 on top. The tube 1 is connected via a gas tight fitting 6 to a channel 7 that allows the input or exit of gas from the space above the porous plug independently of the space 8 in the upper part of the apparatus.

The tube with its packed bed was immersed as shown in FIG. 1 in a bath of molten A357 aluminum alloy 9, with a melting point of 610 C, maintained within a graphite crucible 10 at a temperature of 700 C by a conventional heating element 11. The crucible and heater are within a gas tight space defined by container 12, which is protected from the heat of the heating element 11 by insulation 13. Space 8 was initially filled with argon gas at atmospheric pressure. After five minutes of preheating of the tube containing the packed bed, when the thermocouple 15 showed that the temperature of the molten metal 9 had recovered to the desired value of 700 C after being cooled by introducing of the packed bed and its container, the pressure within the furnace above the layer of molten alloy was increased at the rate of 1.36 bar/min by admission of additional argon gas through input channel 14. This pressure caused the fluid alloy to flow through the packed bed from the bottom, displacing gas from the top of the bed through the porous plug into the separate channel 7.

Figure 2:
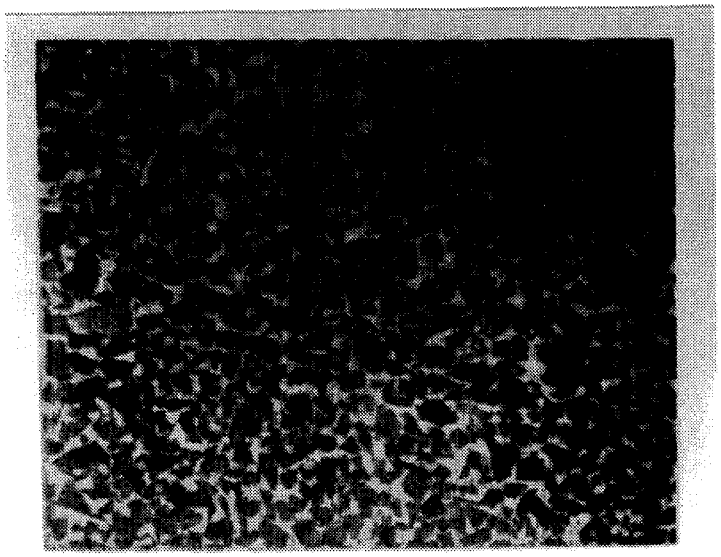
FIGS. 2–3 and 6–7 are cross sections of composites produced according to the invention, or of other composites included for comparison.

When the pressure reached 13.6 bars, the increase in pressure was discontinued and the pressure maintained at that level for five minutes. The entire furnace was then depressurized through outlet 15 and the tube containing the packed bed of SiC, now infiltrated with molten alloy, was removed and cooled in the air to produce a concentrated concentrated composite, which was separated from the quartz tube, by pushing from one end, and then cut into pieces with a diamond saw. A photomicrograph of a polished cross section of the concentrated composite produced is shown in FIG. 2.

Figure 3:
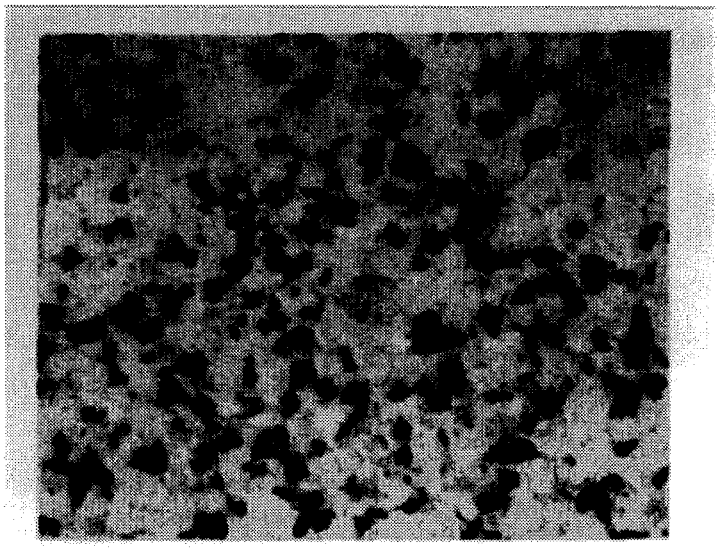

In a separate graphite crucible, 91 g of A357 alloy was melted and heated to 720 C, and a piece weighing 62 g of the concentrated composite prepared as described above was placed on top of the molten alloy. After ten minutes, the material was stirred with a graphite rod to effect a preliminary break-up of the concentrated composite, and a graphite rotating stirrer preheated to 600 C was then immersed and used to stir the melt for 5 minutes at 300 revolutions per minute. The crucible was then removed from the furnace and its contents poured into another crucible and cooled. The resulting composite according to this invention, with 20 volume percent (hereinafter v/o) SiC was examined microscopically after preparing a polished cross section. There was good distribution of the SiC dispersates throughout the composite, with apparently intimate contact at most SiC-metal interfaces and little porosity, as shown in a micrograph of a cross section of the composite in FIG. 3.

EXAMPLE 2

Particles of grit F600 silicon carbide were put into the bottom of a steel crucible to give a packed bed with about 50 v/o SiC. A sufficient amount of molten alloy of 90% Mg - 10% Al to infiltrate the entire packed bed was poured over the bed, and the crucible with its contents placed inside a pressurizable furnace maintained at 700 C. Compressed argon was then admitted to the furnace until the pressure reached 34 bars. This was sufficient to cause the molten alloy to impregnate all of the packed bed except for a small pocket at the bottom into which the air originally present in the packed bed had been displaced.

Figure 8:
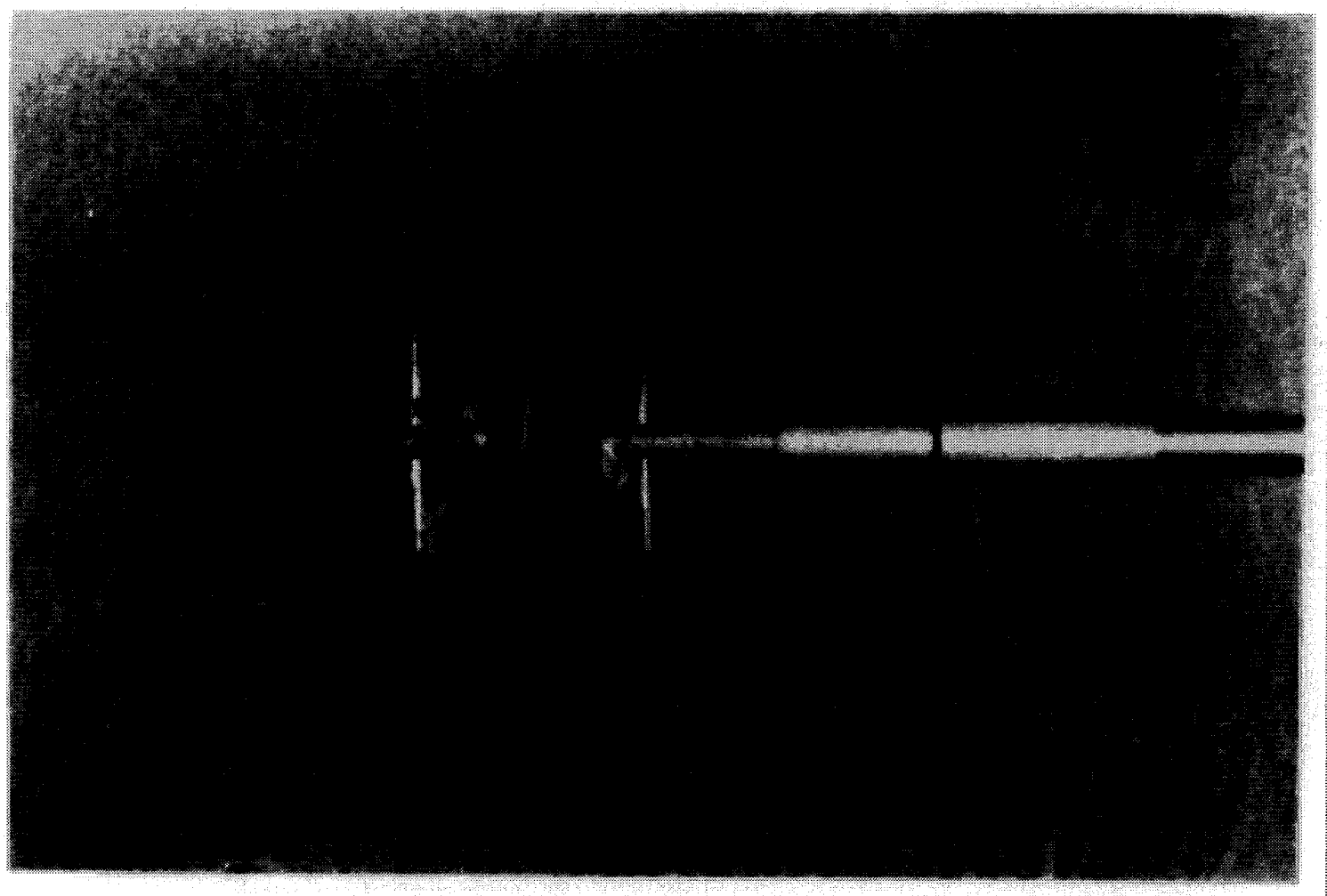
FIG. 8 shows a particular type of stirrer useful in the invention.

A portion of the fully impregnated concentrated composite prepared as described immediately above was softened at 700 C and mixed with an additional amount of molten 90% Mg - 10% Al alloy chosen to result in a final composite with 20 v/o SiC. Mixing was initially accomplished with a hand-held stirring rod until the concentrated composite was sufficiently low in apparent viscosity to allow effective mechanical stirring. Mixing was then continued with a double helical stirrer as shown in FIG. 8 operated at 400 revolutions per minute. This avoided entraining gas through vortex formation. After about five minutes stirring, a semi-solid slurry that could be cast into a mold resulted. The material was then cast and allowed to solidify. A well dispersed final composite was formed.

EXAMPLE 3

This was performed in the same manner as Example 2, except that Grit F500 rather than grit F600 silicon carbide was used.

EXAMPLE 4

This was performed in the same manner as Example 2, except that Grit F320 rather than grit F600 silicon carbide was used.

EXAMPLE 5–7

The preparation of the concentrated composite for these examples was performed in substantially the same manner as in Example 2–4 respectively, except that (i) a slightly different apparatus, one that allowed evacuation as well as pressurization of the space within the container for the dispersates, was used; (ii) initially solid alloy material was added to the container above the packed bed; (iii) the space within the container for the dispersates was evacuated after the solid metal and dispersates had been placed within the furnace, which was maintained at 900 C, before pressurizing to cause infiltration; and (iv) commercially pure magnesium alloy was used for the matrix.

The concentrated composite was mixed with additional molten matrix alloy in a special container, under an argon atmosphere, using an agitator similar to a turbine moving at 2,000–3,000 revolutions per minute. A system of baffles in the container prevented any significant gas entrapment during mixing. The dispersion was mixed for about five minutes at a temperature of about 700 C. The stirrer was then immediately removed and the dispersion promptly cast in a copper chill mold about 9 mm deep. A well-dispersed composite with about 15 v/o dispersates resulted.

EXAMPLE 8

This was performed in the same way as Examples 5–7, except that a finer particle size of silicon carbide, averaging 3 microns in size, was used.

EXAMPLE 9

Figure 4:
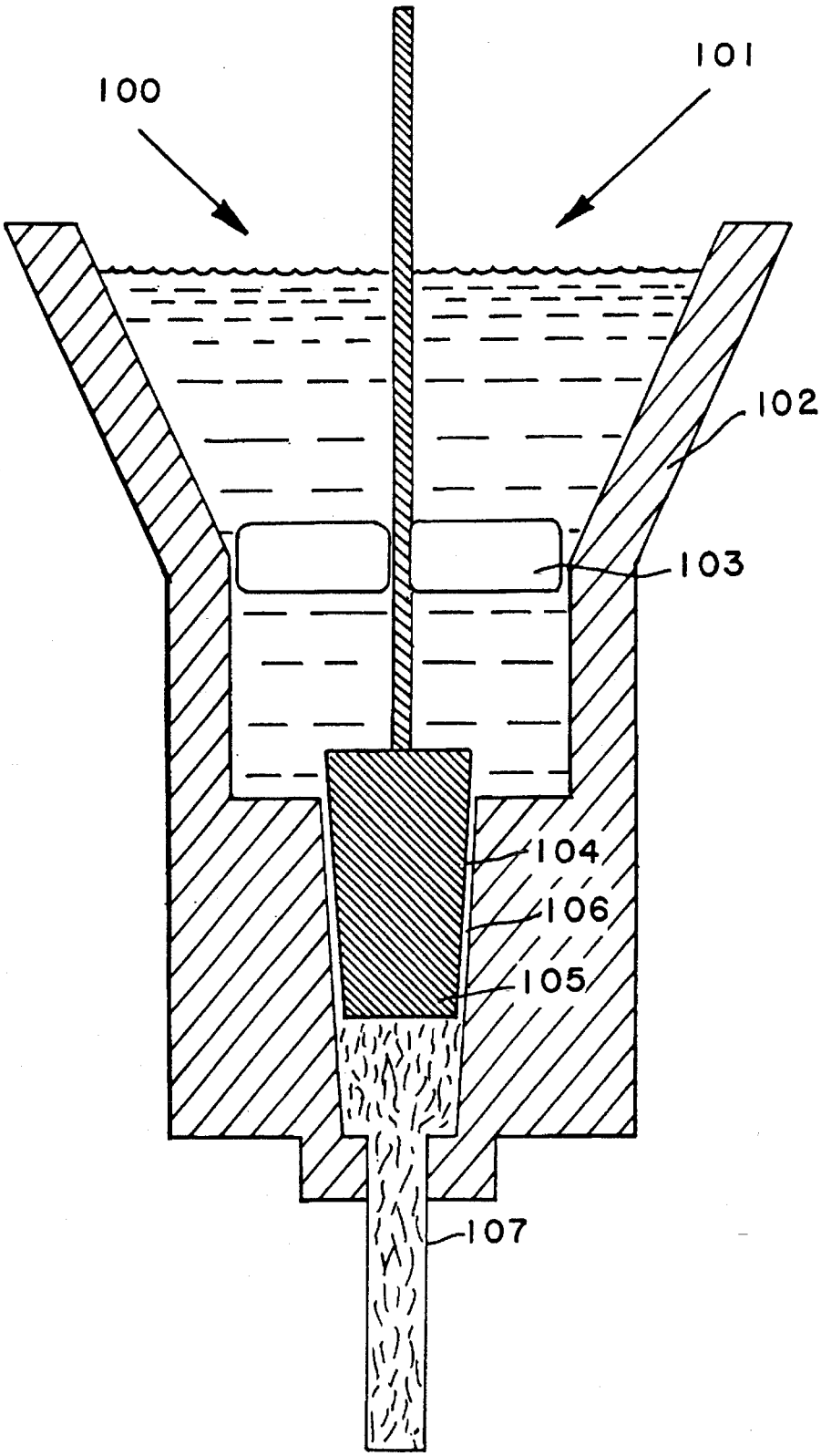
FIGS. 4 and 5 are cross sectional view of apparatus useful for the practice of this invention.

This example illustrates application of the invention to continuous casting and is accomplished with apparatus shown in cross section in FIG. 4. Molten alloy 100 and concentrated composite are continuously fed into a chamber 102 maintained at a temperature that will keep the mixture at least partially fluid. From chamber 102 the mixture is pumped and blended by a rotor 103 into a mixing region 104, where it experiences vigorous agitation. The high shear rates in region 104 are achieved in a narrow gap 104 between chamber wall 105 and a rotor 106. Both the chamber wall and the rotor have surfaces including a conic frustrum with the same taper angle, so that the width of the gap, and correspondingly the rate of shear, can be adjusted by relative vertical displacement between the rotor and the chamber wall. The well dispersed dispersion exits in region 107 and can be fed into a crucible for solidification processing, continuously cast into a billet, or the like.

Alternatively, the concentrated composite itself could be rotated vigorously in a bath of molten alloy so that portions of the concentrated composite are peeled off at the interface as the matrix of the concentrated composite softens under the influence of the higher temperature of the bath of molten alloy.

EXAMPLE 10

Figure 5:
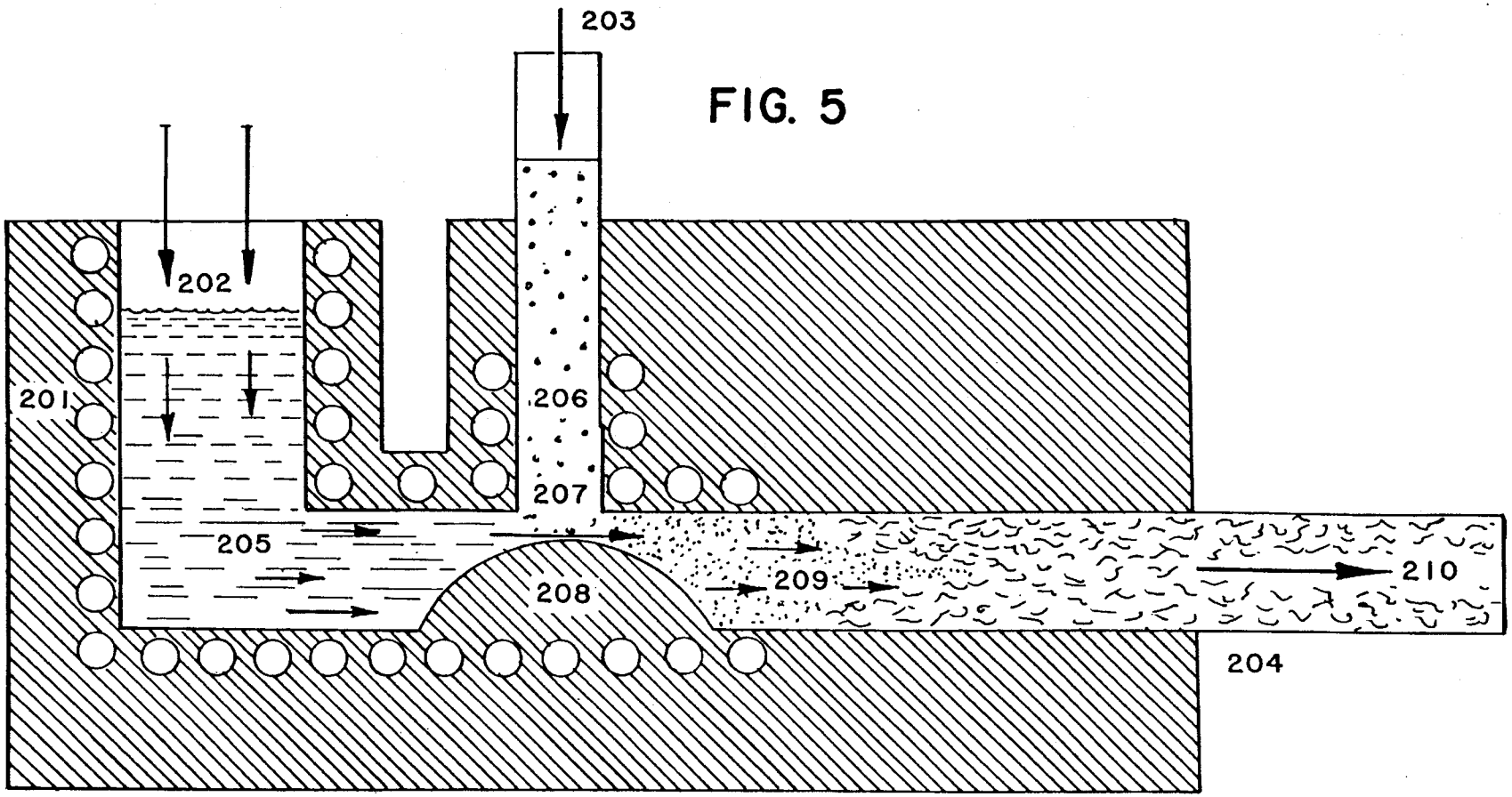

This example illustrates a continuous method embodiment of the invention and may be understood with the aid of FIG. 5, a cross sectional view of apparatus useful for the invention. A solid chamber 201 capable of withstanding the pressures involved is provided with conventional means for maintaining various temperatures in different regions in its interior and contains two inlets 202 and 203 and an outlet 204. At inlet 202, molten metal 205 is supplied under pressure. At inlet 203, dispersates 206 are supplied at an appropriate rate and also under pressure by means of a ram, screw feeder, or other appropriate device known to those skilled in the art.

During operation of the process according to this invention, chamber 201 is kept at a temperature that will maintain molten metal in regions 205 and 207 and at a temperature too low to melt the metal used at the top of region 206, which constitutes a packed bed of dispersates. The flow of dispersates from zone 203 is maintained in a downward direction by mechanical pressure exerted against the packed bed of dispersates, but this does not prevent metal from filling the interparticle space in the packed bed of dispersates in the lower part of the entry region for dispersates, where the temperature is sufficiently high to keep the metal molten. Thus a zone of concentrated composite according to this invention forms in region 207, but upward penetration of the metal is limited by its solidification in the upper part of the inlet 203, creating a more or less distinct boundary between region 207 containing concentrated composite and region 206 with dispersates and gas only.

In the region where the molten metal 205 contacts the concentrated composite 207, the flow rate of the metal is accelerated by a constriction caused by a bulge 208 in the chamber wall. In the region between 208 and 207, the concentrated composite is continuously entrained downstream by the rapidly flowing molten metal and it is sheared and dispersed into the flowing metal. At a sufficient distance downstream from the constriction, a region 209 of substantially homogeneous and nonporous dispersion is obtained. This dispersion can be continuously cast from the outlet 204 to yield a solid continuous billet 210 of the finally desired composite. The volume fractions of metal matrix and dispersates are controlled by regulating the relative feeding rates of dispesates and molten metal at their inlets 203 and 202 respectively.

Instead of a constriction, separate mechanical or electromagnetic stirring could be used to disperse the concentrated composite into additional matrix precursor.

EXAMPLE 10

This was performed in the same manner as Example 1, except that the SiC particulates used were a mixture of equal volumes of FEPA Grit F400, Grit F500, and Grit F600. The Grit F600 had the same size distribution as in Example 1. The Grit F500 material had 3% of its volume in particles larger than 22.5 microns, 50% of its volume in particles larger than 13.7 microns, 94% of its volume in particles larger than 8.7 microns, and the central 75% of its volume in particles with sizes between 10.6 and 17.7 microns, all as measured by a Coulter Counter. Using the same measurement technique, the Grit F400 material had 3% of its volume in particles larger than 25 microns, 50% of its volume in particles larger than 17 microns, 94% of its volume in particles larger than 12 microns, and the central 75% of its volume in particles with sizes between 13 and 20.5 microns.

The central 75% of the volume of the mixture had particles between 7.8 and 19 microns, 3% of the volume of the mixture was in particles smaller than 5.2 microns, and 94% of the volume of the mixture was in particles larger than 21 microns. The final composite produced had an apparently uniform distribution of all particle sizes of SiC within the matrix when examined in cross section.

EXAMPLE 11

This was the same as Example 1, except that the dispersates were boron carbide rather than silicon carbide. Good redistribution of the concentrated composite was obtained in the final composite.

EXAMPLE 12

This was performed in the same as Example 1, except that (i) 100 g of concentrated composite and 215 g of additional A357 alloy were used, to give a 15 v/o composite; (ii) the melt temperature during the mixing of the concentrated composite into the additional molten alloy was only 670 C rather than 700 C; and final stirring was for only 2.5 minutes instead of five. The difference in temperature considerably increased the apparent viscosity during the mixing of the concentrated composite with additional matrix material, and some large air pores were introduced during the stirring and preserved in the final composite. Therefore, even though the SiC dispersates were again well dispersed within the final composite, the results were less preferable than for Example 1.

EXAMPLE 13

Figure 6:
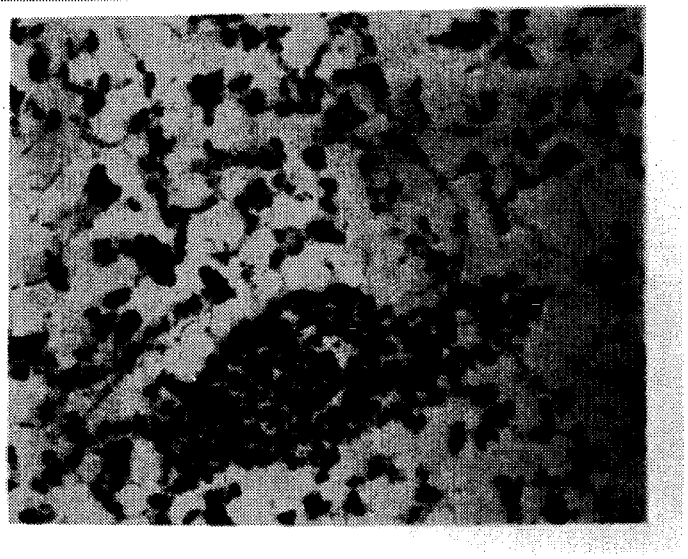
Figure 7:
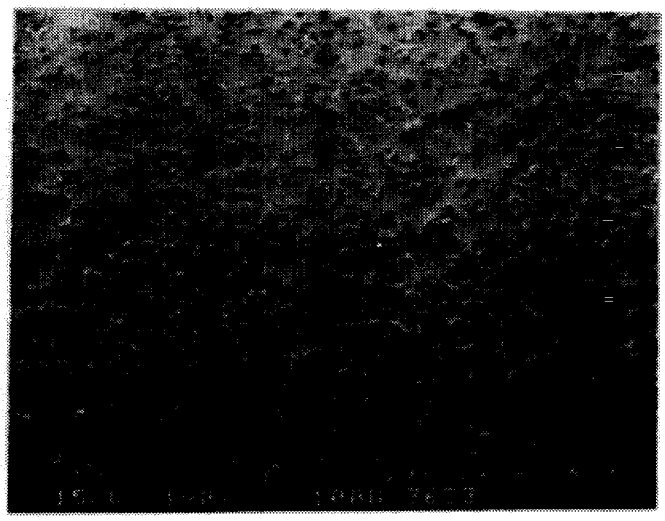

This was performed in the same way as Example 1, except that (i) the alloy used was Type 6061 alloy rather than A357 and (ii) 100 g of concentrated composite and 149 g of additional molten alloy were used in the final mixing step. Type 6061 alloy contains 0.6% Si, 1.0% Mg, 0.3% Mn, and 0.2% Cr, with the balance aluminum. Presumably because of the low silicon content, the dispersion of the concentrated composite within the final composite was not nearly so good as in Example 1. A micrograph of a cross section of the final composite produced in this example is shown in FIG. 6.

EXAMPLE 14

This was performed in the same way as Example 13, except that the alloy used was 10% Si - 90% Al. The result contrasted sharply with that of Example 13, in that the distribution of the SiC dispersates within the final composite was very uniform.

EXAMPLE 15

This was performed in the same way as Example 13, except that the alloy used contained 99.9% aluminum. The dispersion of silicon carbide in the final composite was even less uniform than that achieved in Example 13.

EXAMPLE 16

This was performed in the same way as Example 15, except that (i) the temperature both for preparation and for mixing of the concentrated composite was raised to 800 C; and (ii) 71 g of concentrated composite and 152 g of additional alloy were used in the mixing step, which should have given a final composite with only 15 v/o SiC. In fact, however, mixing the concentrated composite with additional metal proved to be practically impossible. X-ray diffraction of a sample of the concentrated composite showed the presence of aluminum carbide at the interfaces between the dispersates and the matrix. This is believed to be the reason that the concentrated composite was so difficult to break up.

EXAMPLE 17

This was performed in the same manner as Example 16, except that (i) the final mixing was at 720 C rather than 800 C and (ii) the SiC particulates used were heated in air at 1300 C for thirty minutes before being infiltrated to form the concentrated composite. This treatment is known to form a layer of $SiO_2$ on the surface of silicon carbide. Probably because this surface greatly retards the formation of aluminum carbide, of which there was very little indication in an X-ray analysis of this concentrated composite, the concentrated composite could easily be dispersed in the final mixing step. A micrograph of a cross section of the final composite thereby produced is shown in FIG. 6.

EXAMPLE 18

This was the same as Example 1, except that the SiC particulates, before forming the concentrated composite, were coated with alumina in the following manner: A boehmite sol at 10 weight % total solids containing 0.15 weight percent of fine alpha alumina seeds, prepared in a state of incipient gellation as described in detail in U.S. Pat. No. 4,623,364 was prepared. One liter of this sol was mixed with one kilogram of FEPA Grit 600 SiC, and the mixture then pumped through a NIRO spray drier, which caused the SiC to be coated with an apparently uniform coating of dried alumina gel when examined by a scanning electron microscope. The coated particulate was then heated at 1200 C for thirty minutes to convert the alumina Gel to alpha alumina. Conversion was confirmed by X-ray diffraction analysis that shown alpha SiC and alpha alumina as the only phases present.

The final composite prepared in this Example showed an excellent uniformity of dispersion of the SiC within the matrix.

What is claimed is:

1. A process for manufacturing a final composite product in a non-continuous manner having a plurality of discrete solid ceramic dispersates within a solid metal matrix which comprises:

(a) forming a concentrated dispersion of the ceramic dispersates within a first fluid material which is one portion of said solid metal matrix material, wherein said forming entails the steps of (i) forming a packed porous bed of said discrete solid ceramic dispersates (ii) pressure infiltrating said porous bed with said first fluid metal material, and (iii) at least partially solidifying said first fluid metal;

(b) placing at least a portion of the concentrated dispersion of step (a) into a quantity of a second fluid metal material which is a second portion of said solid metal matrix (c) processing the product of step (b) so that the ceramic particles in the concentrated dispersion separate and disperse within a mixture of both of the first and second fluid metal materials; and (d) solidifying the product of step (c) to form the final composite product.

2. A process according to claim 1, wherein said dispersates are comprised predominantly of silicon carbide or boron carbide and said matrix material is comprised predominantly of aluminum or magnesium.

3. A process according to claim 1, wherein the first fluid material and the second fluid material have the same chemical composition.

4. A process according to claim 1, wherein said matrix material is comprised predominantly of aluminum.

5. A process according to claim 1, wherein said matrix material is comprised predominantly of aluminum and silicon.

6. A process according to claim 1, comprising an additional step of solidifying at least part of the first fluid material of said concentrated dispersion before step (b) is performed.

7. A process according to claim 6, wherein said dispersates are comprised predominantly of silicon carbide or boron carbide and said matrix material is comprised predominantly of aluminum or magnesium.

8. A process according to claim 1, wherein the first of fluid material contains a material which facilitates wetting of the dispersates without promoting deleterious chemical reactions.

9. A process according to claim 8, wherein the metal matrix material contains predominantly aluminum and silicon.

10. A process according to claim 1, wherein said packed porous bed is evacuated before said infiltrating.

11. A process according to claim 10, wherein said dispersates are comprised predominantly of silicon carbide or boron carbide and said matrix material is comprised predominantly of aluminum or magnesium.

12. A process according to claim 10, comprising an additional step of solidifying at least part of the first fluid material of said concentrated dispersion before step (b) is performed.

13. A process according to claim 12, wherein said dispersates are comprised predominantly of silicon carbide or boron carbide and said matrix material is comprised predominantly of aluminum or magnesium.

14. A process according to claim 1, wherein said packed porous bed contains interparticle gas and said infiltrating is performed from one side of said bed at a sufficiently slow rate to allow displacement of the gas originally within said packed bed by said first fluid material.

15. A process according to claim 14, wherein said dispersates are comprised predominantly of silicon carbide or boron carbide and said matrix material is comprised predominantly of aluminum or magnesium.

16. A process according to claim 14, comprising an additional step of solidifying at least part of the first fluid material of said concentrated dispersion before step (b) is performed.

17. A process according to claim 16, wherein said dispersates are comprised predominantly of silicon carbide or boron carbide and said matrix material is comprised predominantly of aluminum or magnesium.

* * * * *